United States Patent [19]

Iwabuchi et al.

[11] Patent Number: 4,868,359

[45] Date of Patent: Sep. 19, 1989

[54] RADIATION SEALED DOOR IN A MICROWAVE HEATING APPARATUS

[75] Inventors: Koji Iwabuchi; Tetsuo Kubota, both of Chiba; Yukio Tanaka, Tokyo; Masaharu Tawada, Chiba, all of Japan

[73] Assignee: Hitachi Heating Appliances, Co., Ltd., Chiba, Japan

[21] Appl. No.: 82,471

[22] Filed: Aug. 7, 1987

[30] Foreign Application Priority Data

| | | | |
|---|---|---|---|
| Aug. 7, 1986 | [JP] | Japan | 61-185519 |
| Aug. 12, 1986 | [JP] | Japan | 61-189277 |
| Sep. 12, 1986 | [JP] | Japan | 61-215365 |
| Sep. 12, 1986 | [JP] | Japan | 61-215371 |

[51] Int. Cl.[4] ..... H05B 6/76

[52] U.S. Cl. ..... 219/10.55 D; 219/10.55 R; 174/35 MS; 174/35 GC

[58] Field of Search ..... 219/10.55 D, 10.55 R; 174/35 R, 35 GC, 35 MS

[56] References Cited

U.S. PATENT DOCUMENTS

| | | | |
|---|---|---|---|
| 4,254,318 | 3/1981 | Ohkawa et al. | 219/10.55 D |
| 4,475,023 | 10/1984 | Iwabuchi et al. | 219/10.55 D |
| 4,523,069 | 6/1985 | Staats | 219/10.55 D |
| 4,584,447 | 4/1986 | Kusunoki et al. | 219/10.55 D |
| 4,659,891 | 4/1987 | Yamaguchi et al. | 219/10.55 D |
| 4,742,201 | 5/1988 | Nakano et al. | 219/10.55 D |

FOREIGN PATENT DOCUMENTS

| | | |
|---|---|---|
| 0184069 | 6/1986 | European Pat. Off. . |
| 2224661 | 12/1974 | Fed. Rep. of Germany . |
| 2853616 | 7/1979 | Fed. Rep. of Germany . |
| 3029648 | 3/1981 | Fed. Rep. of Germany . |
| 8205749 | 7/1982 | Fed. Rep. of Germany . |
| 3106786 | 9/1982 | Fed. Rep. of Germany . |
| 3521666 | 6/1985 | Fed. Rep. of Germany . |
| 3242125 | 7/1985 | Fed. Rep. of Germany . |
| 3518060 | 11/1985 | Fed. Rep. of Germany . |
| 53-15645 | 2/1978 | Japan . |
| 60-25190 | 2/1985 | Japan . |
| 795 | 1/1986 | Japan . |

*Primary Examiner*—Philip H. Leung

*Attorney, Agent, or Firm*—Sughrue, Mion, Zinn, Macpeak & Seas

[57] ABSTRACT

A seal on a door for a microwave oven. The seal is a resonant cavity extending along the flange of the oven. The resonant cavity has an offset inlet facing the flange with a dimension less than $\frac{3}{8}$ of the distance to the center of the cavity. The cavity is further interrupted at intervals less than $\frac{1}{2}$ of the microwave wavelength. A dielectric cover fills the inlet and has projections into the cavity on either side of the inlet.

13 Claims, 3 Drawing Sheets

RADIATION SEALED DOOR IN A MICROWAVE HEATING APPARATUS

BACKGROUND OF THE INVENTION

1. Field of the Invention

The present invention relates to an improvement in the door seal arrangement of a microwave oven (heating apparatus).

2. Background of the Invention

Japanese Patent Unexamined Application Publication No. 25190/1985 discloses a proposal in which grooves are formed in a circumferential edge of a door of a microwave oven. The grooves each have a different characteristic impedance in the direction of the depth of the door. The characteristic impedance of the grooves in the direction of the depth is made discontinuous so that the impedance at the inlet of the grooves become a maximum even if the substantial depth is smaller than one-fourth of the wavelength to be used. It thereby becomes possible to reduce the wave leakage similarly to choke grooves. In this example of the prior art, the structure is considerably complicated because grooves are different in width in the direction of groove depth and the shape of the peripheral wall of the grooves is varied in the direction of depth. Further, it is necessary to consider prevention of reflection at portions where the characteristic impedance is discontinuous.

As shown in FIG. 1, Japanese Utility Model Unexamined Application Publication No. 795/1986 discloses a structure in which a cavity resonator 12 having a bent form and having a rectangular section for preventing radiation leakage is provided in the outer circumference of a door 5. An inlet 25 is formed by opposing a cut end plane of an extending surface 11 (which is one of peripheral walls of the cavity resonator 12) to another wall surface (a first wall surface 8) of the cavity resonator 12 to thereby define the inlet 25. In this example of the prior art, waves of higher order modes which may travel not only in the illustrated y-z plane but also in other directions come into the cavity resonator 12. Such oblique waves cause the cavity resonator 12 to not be in a resonant state for the oblique waves to thereby reduce the effect of preventing radiation leakage.

Furthermore, in the conventional example, it is necessary that the size of the section AB of the cavity resonator 12 is large, and therefore the cavity resonator is unsuitable for reduction in size as well as cost of the door.

In FIG. 1 the drawing in the specification of the above-mentioned Japanese Utility Model Unexamined Application Publication No. 61-795 is shown with the same dimensional ratio of the various parts, and the same names and numerical references of the constituent elements corresponding to those of the present invention are used.

As described above, in the conventional microwave oven, there have been problems in that it is necessary to form a groove having a complicated shape, the arrangement of reflection prevention at the characteristic impedance discontinuous portion is troublesome, and the door cannot be reduced in size.

SUMMARY OF THE INVENTION

According to the present invention, a radiation leakage preventing cavity resonator having a rectangular cross section is provided in a circumference of a door. Three of the four surfaces forming of the cavity resonator are formed by a number of U-shaped electrically conductive pieces provided longitudinally in the circumference of the door. The remaining one of the four surfaces is placed opposite to respective cut ends of the U-shaped electrically conductive pieces to each other to thereby form an inlet for leading a leaking wave into the cavity resonator. The ratio $l_M/G$ is selected to be equal to or larger than 1.5 where $l_M$ represents a distance between the inlet and the center of the sectional area of the cavity resonator and G represents a size of the inlet.

Further, there are provided a dielectric cover and a plurality of capacitance adjusting elements projected from the dielectric cover at special positions.

According to the present invention, a radiation leakage preventing cavity resonator having a rectangular cross section is provided in a circumference of a door. Part of a wall surface of the cavity resonator is formed by a number of U-shaped electrically conductive pieces. An inlet for leading a leaking wave into the cavity resonator is formed by part of the U-shaped electrically conductive pieces and part of another wall surface. The ratio $l_M/G$ is selected to be equal to or larger than 1.5 where $l_M$ represents a distance between the inlet and the sectional areal center of the cavity resonator and G represents a size of the inlet. Furthermore, two capacitance adjusting elements are provided at opposite end portions of the inlet, one of the capacitance adjusting elements provided at the other wall surface side being selected to be larger than the other capacitance adjusting element provided at the U-shaped electrically conductive pieces side.

Further, an end surface of each of the U-shaped electrically conductive pieces is arranged to be in contact with a second wall surface.

In the arrangement described above, the U-shaped electrically conductive pieces act to lead a leaking wave as a TEM wave into the cavity resonator which is rectangular in cross section. The cavity resonator forms a parallel resonance element constituted by equivalent inductance L in proportion to the sectional area of the cavity approximately as a one-turn cylindrical coil and by equivalent capacitance C arising from a disturbed electric field in the vicinity of the inlet of the cavity. As the inlet of the cavity is made smaller, the value of C becomes larger and the value of L can be made correspondingly smaller. That is, the sectional area of the cavity can be made small. The wave sealing effect becomes maximum when each side of the rectangular section of the cavity is smaller in dimension than ¼ of the wavelength to be used.

DETAILED DESCRIPTION OF THE PREFERRED EMBODIMENTS

Figure 1:
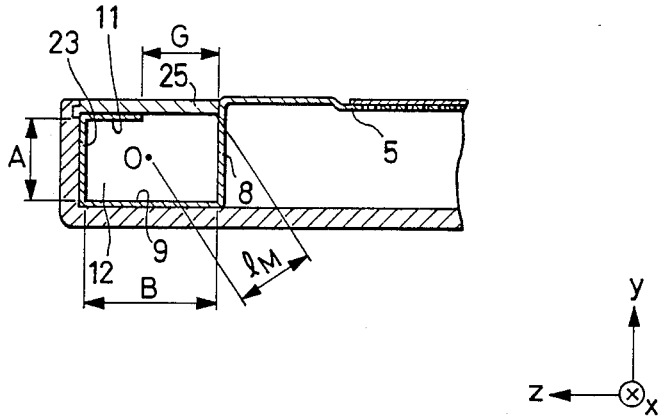
FIG. 1 is a view for explaining a structure of the conventional wave seal structure.

Referring to the drawings, a structure and an operation of an embodiment of the microwave heating apparatus according to the present invention will be described.

Figure 7:
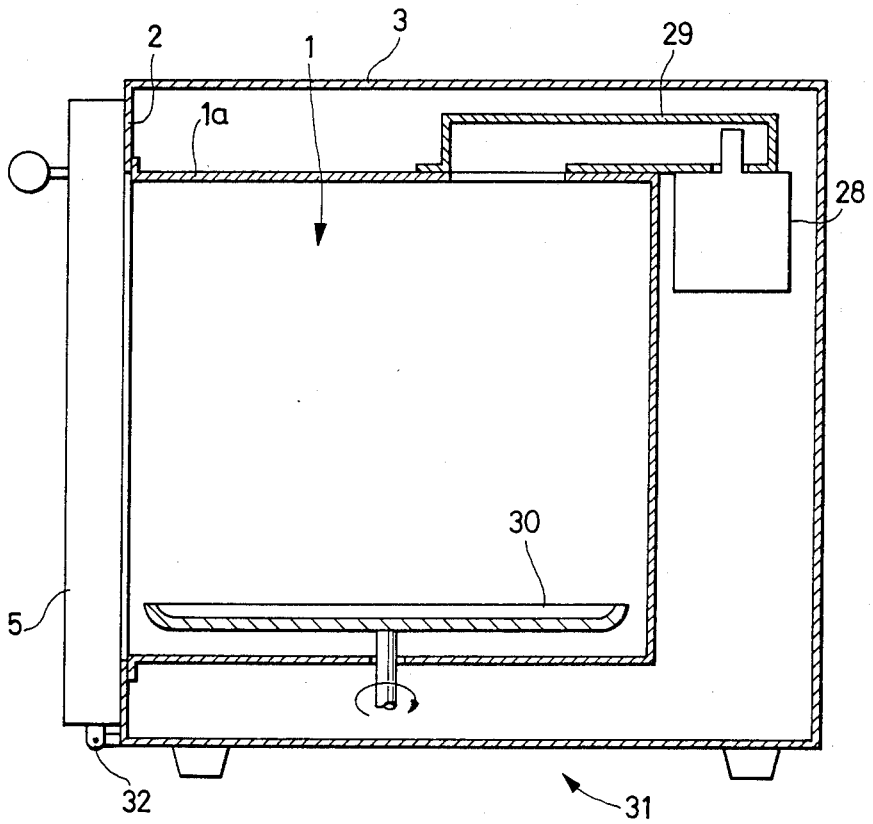
FIG. 7 is a view showing a schematic cross section of a microwave heating apparatus of the present invention.

FIG. 7 shows a schematic cross section of a microwave heating apparatus 31 of an embodiment of the present invention. The microwave heating apparatus 31 has an outer casing 3 in which a heating chamber 1 for receiving an object to be heated is formed. The heating chamber 1 is surrounded by a wall 1*a*. Microwave energy is generated in a microwave generator (magnetron) 28. A heating chamber 1 is supplied with the microwave energy generated in the generator 28 through a wave guide 29. A turntable 30 is rotatably mounted in the heating chamber 1. The object to be heated is mounted on the turntable 30 so that the object will be uniformly heated. An openable/closable door 5 is provided via a hinge 32 to face an opening portion of the heating chamber 1. The peripheral portions of the door 5 face the flange 2 extended from the front end portion of the wall 1*a*. The structure of the peripheral portions of the door 5 contacting the flange 2 is shown in greater detail in FIG. 3.

Figure 2:
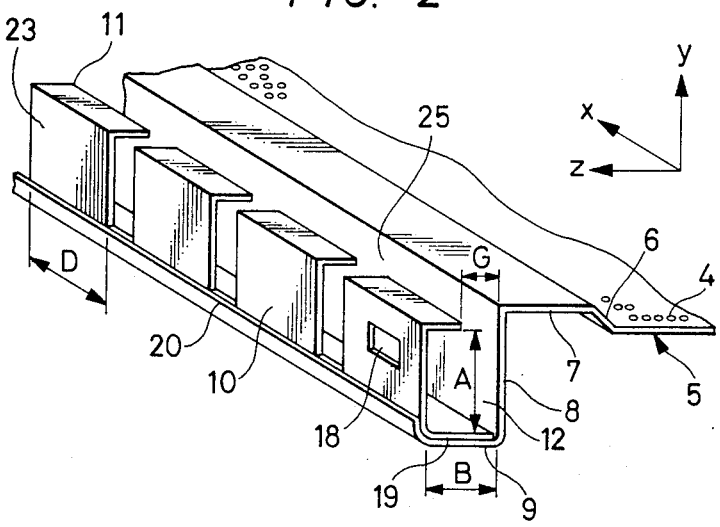
FIG. 2 a perspective view showing only a main portion of a metal portion of a door 5 in an embodiment of the microwave heating apparatus according to the present invention.
Figure 3:
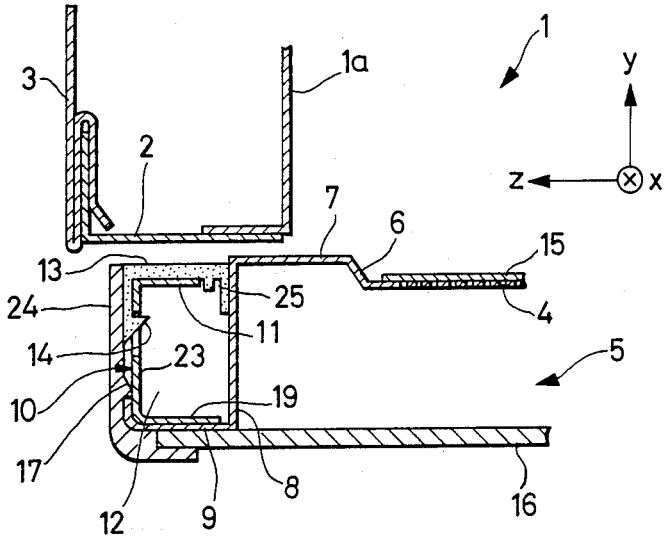
FIG. 3 is a cross section showing a main portion of a wave seal portion in a circumference of the door.

As shown in FIGS. 2 and 3, the flange 2 extended from the front end portion of the wall 1*a* of the heating chamber 1 surrounds the opening portion of the heating chamber 1 and is surrounded by the outer casing 3. Small apertures 4 are provided in a door 5 at its central portion in a region as wide as possible so as to provide viewing of the inside of the heating chamber 1. A stepped portion 6 surrounds a circumference of the location of the small apertures 4. The stepped portion 6 positions an end portion of a light transmitting inner cover 15 of the door 5 fixed to the inner surface of the small apertures 4 and prevents it from being peeled in cleaning or the like. It also improves the flatness of a seal surface 7 which is arranged to come into plane-contact with the flange 2 when the door 5 is closed. A first wall surface 8 is bent substantially perpendicularly to the flange 2 at an end portion of the seal surface 7. A second wall surface 9 extends substantially in parallel with the flange 2 from an end portion of the first wall surface 8.

A number of U-shaped electrically conductive pieces 10 are welded to the second wall surface 9. Each of the U-shaped electrically conductive pieces 10 is constituted by three surfaces, that is, an attaching surface 19 welded to the second wall surface 9, an upright surface 23 substantially in parallel opposite to the first wall surface 8, and an extending surface 11 opposed at its cut end to the first wall surface 8. A width D of each of the U-shaped electrically conductive pieces 10 in the longitudinal direction in the circumference of the door 5 (in the x-direction in FIGS. 1 and 3) is made smaller than ½ of the wavelength to be used. A rectangular section surrounded by the first wall surface 8 and the U-shaped electrically conductive pieces 10 form a cavity resonator 12 having a narrow inlet 25. An opaque dielectric cover 13 closes the inlet 25 of the cavity resonator 12. A protrusion 14 projecting from the dielectric cover 13 is arranged to be caught by an attaching hole 18 provided in one or more of the upright surfaces 23 of the U-shaped electrically conductive pieces 10. An outer door frame 24 made of dielectric material holds a light-permeable outer cover 16 of the door 5 covering a front surface of the door 5. A protrusion 17 projecting from the outer door frame 24 is arranged to hook on an outer peripheral end portion 20 of the second wall surface 9.

Figure 4:
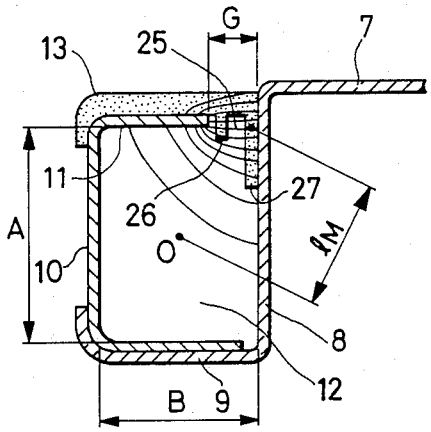
FIG. 4 is a view showing the electric field distribution in the wave seal portion.

As shown in more detail in FIG. 4, one or more (two in the illustrated embodiment) capacitance adjusting element portions 26 and 27 project from the dielectric cover 13 into the cavity resonator 12 such that at least one of them is placed in the vicinity of the cut end of the extended surface 11. As a result, the U-shaped electrically conductive pieces 10 are prevented from being bent (in the direction in which the inlet 25 is reduced) when an impact is applied externally. The dielectric cover 13 in FIG. 4 shows a cut end of a portion having no protrusion 14.

Further, of the capacitance adjusting elements 26 and 27 projecting from the dielectric cover 13 in the vicinity of the extending surface 11 and in the vicinity of the first wall surface 8 respectively, the right capacitance adjusting element 27 in the vicinity of the first wall surface 8 is made larger in projecting length than the other capacitance adjusting element 26.

The operation and effects in the embodiment arranged as described above will be described hereunder. First, a wave seal effect against an incident wave coming into a plane contact portion of the flange 2 surrounding the opening portion of the heat chamber 1 and the seal surface 7 will be described in reference to the simple equivalent circuit shown in FIG. 5. A capacitance 21 corresponding to the plane contact portion between the flange 2 and the seal surface 7 acts as a kind of bypass capacitor. The planar connecting portion is considered as a parallel plate line. The capacitance of the line is in inverse proportion to the gap between the parallel plates so that the capacitance 21 becomes larger to increase the wave seal effect as the gap of the plane-contact portion becomes smaller.

Figure 6:
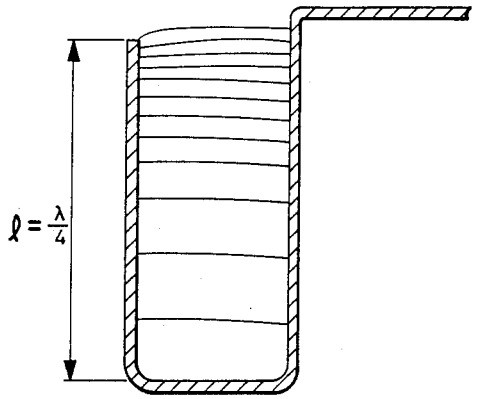
FIG. 6 is a view showing the electric field distribution in the parallel plate lines with the terminal thereof shorted.

The width D (in the x-direction in FIG. 3) of each of the U-shaped electrically conductive pieces 10 is made smaller than ½ of the wavelength to be used so that the propagation direction of the wave coming into the inside of the cavity resonator 12 having the rectangular section defined by the first wall surface 8 and the U-shaped electrically conductive pieces 10 is limited to within the y-z plane in FIG. 3. If the extending surface 11 is not provided, the electric field is distributed as shown in FIG. 6, in which a parallel resonance is generated in the case where the length l of the parallel plate line is made to be about ¼ of the free space wave length λ so as to maximize the impedance to thereby make it possible to prevent the wave from leaking. However, the length l is 30.6 mm in the microwave heating apparatus operating at 2450 MHz. Accordingly, if it is intended to actually provide such a parallel plate line having a length l in the door, the door becomes so thick as to be disadvantageous in design as well as in cost.

Figure 5:
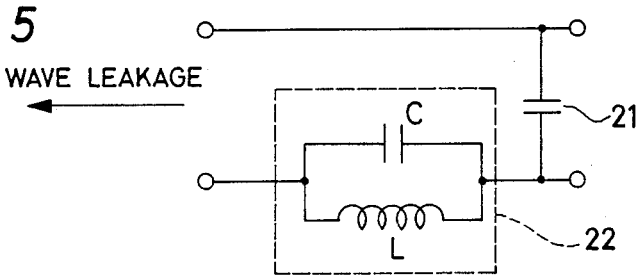
FIG. 5 is a diagram of a simple equivalent circuit of the wave seal portion of the door 5.

The electric field is distributed as shown in FIG. 4 in the case in which the cavity resonator 12 having a rectangular section is provided and the narrow inlet 25 is formed by providing the extending surface 11 similarly to the present invention. In that case, the greater part of the electric flux lines are concentrated between the vicinity of the cut end of the extending surface 11 and the first wall surface 8. In FIG. 5, the cavity resonator 12 is illustrated as a parallel resonance element constituted by equivalent inductance L and equivalent capacitance C. The equivalent inductance L functions as a one turn cylindrical coil having approximately the same cross section as that of the cavity resonator 12 and the cavity resonator 12 thus provides equivalent inductance as a constant of the coil. The value of the equivalent inductance L per unit length in the cylinder axial direction (in the x-direction) is expressed by the following equation (1). The equivalent capacitance C arises from the disturbed electric field in the vicinity of the inlet 25 of the cavity resonator 12 and is approximately expressed by the following equation (2).

$$L = \mu_o AB \tag{1}$$

$$C = \left( \frac{2}{n} \ln \frac{\sqrt{2}\, e l_M}{G} - K \right) \epsilon_o \tag{2}$$

where AB represents the area of the rectangular cross section of the cavity 12, $\mu_o$ represents the magnetic permeability of the medium in the cavity resonator 12, e is 2.72, $l_M$ represents the distance between the inlet 25 and the areal center O of the cavity cross section of the cavity resonator 12, $\epsilon_o$ represents the dielectric constant of the medium in the cavity resonator 12, K represents a correction term related to the shape in the vicinity of the inlet 25, and G represents the distance across the gap of the inlet 25 (the size of the inlet 25).

The resonance frequency $f_o$ of the cavity resonator 12 is represented by the following equation (3).

$$f_o = \frac{1}{2\pi \sqrt{LC}} \tag{3}$$

From equation (2), it can be found that the equivalent capacitance C becomes larger as the gap G of the inlet 25 is made smaller or $l_M/G$ is made larger. From equation (3), it can be found that the equivalent inductance L may be made smaller as the equivalent capacitance C is made larger with the resonance frequency $f_o$ kept constant. In order to make the equivalent inductance L small, the area AB of the rectangular cross section of the cavity resonator 12 may be made small on the basis of equation (1). That is, in order to reduce the cavity resonator 12 in size, it will do to reduce the size of the gap G of the inlet 25 to thereby make the equivalent capacitance C large. Making the cavity area AB small correspondingly reduces the equivalent inductance L. Thus, in this condition, it will do to generate a parallel resonance at a predetermined resonant frequency $f_o$ (the heating frequency of the microwave oven) to thereby maximize the impedance at the inlet 25 to prevent the wave from leaking.

In the microwave oven having a heating frequency of 2,450 MHz and microwave energy of 500 watts, the gap between the flange 2 and the seal surface 7 was selected to be 2 mm, the step height between the extending surface 1 and the seal surface 7 was selected to be 3 mm, and the width D of each of the U-shaped electrically conductive pieces was selected to be 15 mm. Water in the quantity of 275 ml was heated. In that condition, the quantity of radiation leakage was measured at a position 5 cm away from the circumference of the door 5. As a result, under the conditions that G=5 mm, AB=15.4×15.9 mm, and $l_M/G=2.1$, the quantity of wave leakage was not larger than 0.1 mW/cm$^2$. On the other hand, if under the condition that G=8 mm, it was necessary to set the other conditions so that AB=20.4×18.4 mm and $l_M/G=1.75$ in order to minimize the quantity of radiation leakage to substantially the same extent as the above case. Thus, in this latter case, the area of the rectangular cross section of the cavity resonator 12 becomes large. From the experiment, it has been found that the dimensions A and B of the rectangular cross section of the cavity resonator 12 can be made considerably smaller than 30.6 mm which is ¼ of the wavelength λ to be used, by making the gap G of the inlet 25 to be narrow to value within a range from about 4 to 8 mm and making $l_M/G$ to be equal to or larger than 1.5.

The portions 26 and 27 projected from the dielectric cover 13 are formed as the capacitance adjusting elements for surely adjusting the equivalent capacitance C of the cavity resonator 12 to thereby reliably obtain a parallel resonance. Being provided also in the vicinity of the cut end of the extending surface 11, the capacitance adjusting elements 26 and 27 are useful for preventing deformation of the U-shape electrically conductive pieces 10 so that a stable wave seal effect can be kept for a long time.

The equivalent capacitance C can be adjusted by the capacitance adjusting elements 26 and 27 to dependably generate a parallel resonance to thereby improve the wave seal effect. Further, the capacitance adjusting element 27 provided in the vicinity of the first wall surface 8 is selected to be longer in projecting length than the capacitance adjusting element 26 provided in the vicinity of the end portion of the extending surface 11. As a result, when the dielectric cover 13 is fitted, the capacitance adjusting element 27 is first inserted along the first wall surface 8 and after positioning of the capacitance adjusting element 27, the capacitance adjusting element 26 enters the inlet 25. Accordingly, there is no possibility that the capacitance adjusting element 26 presses the extending surface 11 in the y-direction to thereby deform the extending surface 11. The capacitance adjusting element 26 is used also to minimize the deformation of the extending surface 11 against the external force in the z-direction in the condition that the dielectric cover is fixed.

As described above, according to the present invention, the inlet of the cavity resonator having a rectangular cross section surrounded by a number of the U-shaped electrically conductive pieces and the first wall surface is made narrow with a structure in which the cut end plane of the extending surface of each of the U-shaped electrically conductive pieces and the first wall surface are made opposite to each other. The dimensions are selected to satisfy, for example, $l_M/G \geqq 1.5$. Accordingly, the dimensions A and B of the cross section of the cavity resonator can be made smaller than ¼ of the wavelength λ to be used, the shape of the cavity resonator can be simplified, and the door can be made small and thin. Accordingly, it is possible to provide a microwave heating apparatus which is compact and which is easy in assembling, resulting in a significant effective economical point of view.

Further, a parallel resonance can be surely generated by the provision of one or more capacitance adjusting elements.

Further, at least one of the capacitance adjusting elements is provided in the vicinity of the cut end of the extending surface, so that the U-shaped electrically conductive pieces can be prevented from being deformed against external force (in the z-direction) to thereby improve the stability of the wave sealing effect.

Further, each of the U-shaped electrically conductive pieces is arranged such that one end surface thereof is made to be in contact with the second wall surface. Accordingly, the assembling work is made easy.

What is claimed is:

1. A microwave heating apparatus, comprising:
a microwave irradiation chamber;
a source of microwave radiation feeding said microwave chamber;
a door for opening and closing an opening portion of said microwave chamber;
a seal surface disposed at a circumferential edge of said door and disposed to come into planar contact with a flange adjacent to said opening portion of said microwave chamber;
a conductive first wall surface extending substantially perpendicularly to said flange away from an end portion of said seal surface;
a conductive second wall surface disposed substantially perpendicularly to said first wall surface;
a conductive upright surface extending substantially perpendicularly from said second wall surface; and
a conductive extending surface extending substantially perpendicularly from said upright surface and having a free end thereof terminating at a position opposed to and separated from said first wall surface by a first gap of length G, said first and second wall surfaces, said upright surface and said extending surface forming a resonant cavity of substantially rectangular cross section, said first gap being disposed on a side of said extending surface close to said opening portion of said irradiation chamber when said door closes said opening portion;
wherein a ratio of $l_M/G$ is selected to be equal to or larger than 1.5 where $l_M$ is a distance between said gap and an areal center of said rectangular cross section of said resonant cavity.

2. A microwave heating apparatus as recited in claim 1, wherein said second wall surface includes a first planar portion and a second planar portion having juxtaposed and electronically connected planar surfaces and wherein said second planar portion, said upright surface and said extending surface are comprised by at least one U-shaped conductive piece.

3. A microwave heating apparatus as recited in claim 2, wherein said U-shaped conductive piece has a width less than ½ of a wavelength of microwave radiation in said microwave chamber.

4. A microwave heating apparatus as recited in claim 3, wherein every rectangular dimension of said cross section is less than ¼ of said wavelength.

5. A microwave heating apparatus as reciting in claim 2, wherein said first wall surface and said first planar portion are an integral piece and said surface integral piece further includes a portion contacting and extending along said upright surface.

6. A microwave heating apparatus as recited in claim 1, wherein every rectangular dimension of said cross section is less than ¼ of a wavelength of microwave radiation in said microwave chamber.

7. A microwave heating apparatus as recited in claim 1, further comprising a dielectric cover covering said first gap and including a plurality of capacitance adjusting elements projecting into said resonant cavity and arranged across said gap, at least one of said resonant projections being disposed in a vicinity of said free end of said extending surface.

8. A heating apparatus as recited in claim 7, wherein one of said capacitance adjusting elements is disposed adjacent to said first wall and has a length longer than said resonant projection disposed in said vicinity of said free end.

9. A microwave heating apparatus, comprising:
a microwave irradiation chamber;
a source of microwave radiation feeding said microwave chamber;
a door for opening and closing an opening portion of said microwave chamber, said irradiation chamber having a flange adjacent to said opening portion of said microwave chamber;
a seal surface disposed at a circumferential edge of said door and disposed to come into planar contact with said flange;
a conductive first wall surface extending substantially perpendicularly to said flange away from an end portion of said seal surface;
a conductive second wall surface disposed substantially perpendicularly to said first wall surface; and
a plurality of U-shaped conductive pieces having two parallel legs, an attaching surface of one of said legs being attached to said second wall surface, the other of said parallel legs extending entirely in parallel to said one leg and terminating at a free end opposed to said first wall surface, said U-shaped pieces and said first wall surface forming a resonant cavity of substantially rectangular cross section having a first gap of length G between said free end of the other said legs and said first wall surface, said first gap being disposed at a side closer to the opening portion of said microwave chamber when said door closes and said opening portion,
wherein a ratio of $l_M/G$ is selected to be equal to or larger than 1.5 where $l_M$ is a distance between said gap and an areal center of said rectangular cross section of said resonant cavity.

10. A microwave heating apparatus as recited in claim 9, wherein a width of said U-shaped piece is less than ½ of a wavelength of said microwave radiation in said microwave chamber.

11. A microwave heating apparatus as recited in claim 9, further comprising a dielectric cover covering said first gap and including at least two capacitance adjusting elements projecting into said resonant cavity and arranged across said first gap, at least one of said resonant projections being disposed in a vicinity of said free end of said extending surface and another of said capacitance adjusting elements is disposed adjacent to said first wall and has a length longer than said resonant projection disposed in said vicinity of said free end.

12. A microwave heating apparatus as recited in claim 11, wherein said U-shaped piece comprises said attaching surface attached to said second wall surface, an upright surface being said one leg and extending substantially perpendicular from said attaching surface and an extending surface being said other leg and extending substantially perpendicular from said upright surface and having said free end, wherein said U-shaped piece is disposed with said attaching surface being attached to said second wall surface such that the upright surface extends substantially parallel to said first wall surface and said free end of said extending surface faces said first wall surface and wherein said first gap is formed between said free end of said extending surface and said first wall surface.

13. A microwave heating apparatus as recited in claim 12, wherein every rectangular dimension of said cross section is less than ¼ of a wavelength of said microwave radiation in said microwave chamber.

* * * * *